US005199933A

United States Patent [19]

Illuzzi

[11] Patent Number: 5,199,933

[45] Date of Patent: Apr. 6, 1993

[54] EXERCISE APPARATUS

[76] Inventor: Joseph F. Illuzzi, 2 Primrose La., Apt. 1A, Fords, N.J. 08863

[21] Appl. No.: 895,903

[22] Filed: Jun. 9, 1992

[51] Int. Cl.[5] ..... A63B 22/12; A63B 69/16

[52] U.S. Cl. ..... 482/62

[58] Field of Search ..... 482/57, 62, 148, 45, 482/46

[56] References Cited

U.S. PATENT DOCUMENTS 4,451,033 5/1984 Nestegard ..... 482/62

4,741,527 5/1988 Nestegard ..... 482/62

FOREIGN PATENT DOCUMENTS 2814756 10/1979 Fed. Rep. of Germany ..... 482/62

*Primary Examiner*—Stephen R. Crow

*Attorney, Agent, or Firm*—Gerald S. Rosen

[57] ABSTRACT

An apparatus for use with an exercise bicycle or a regular bicycle adapted for use as an exercise bicycle which comprises two elongated poles which are tapered at one end and optionally one of which is slidingly attached to a crossbar, said poles are inserted into eyebolts on the pedals of such bicycles. The eyebolts rotate axially independently of the axial rotation of the pedals to which they are attached and the pole or pipes can be moved in a circular arc in the eyebolts forward of and behind the vertical plane of the user's body.

6 Claims, 6 Drawing Sheets

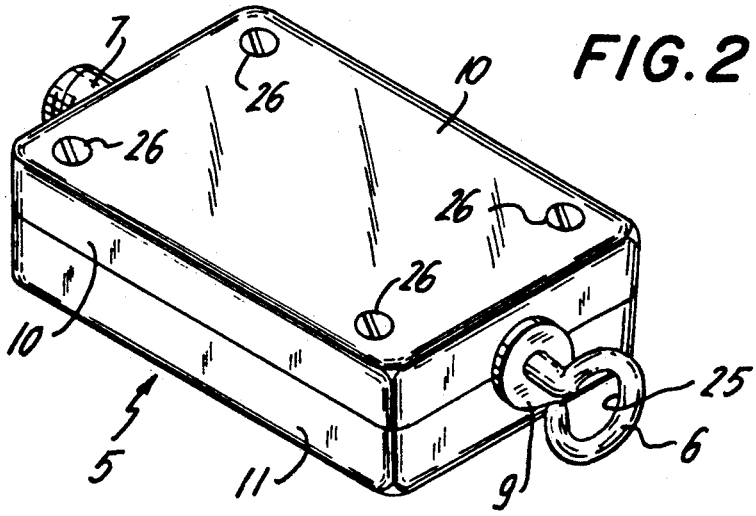
FIG. 2
FIG. 3
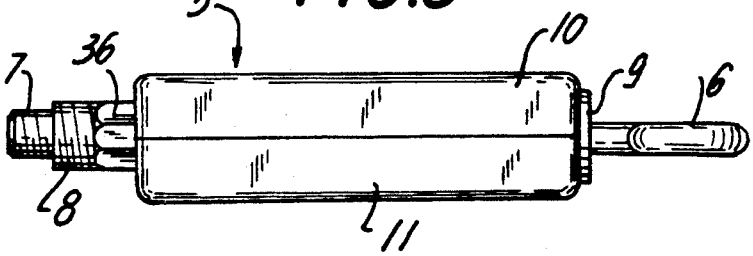
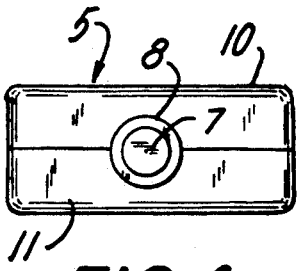
FIG. 4
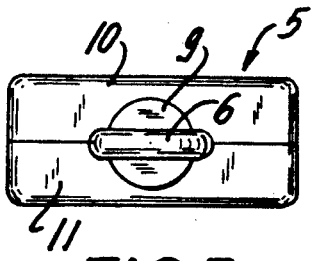
FIG. 5
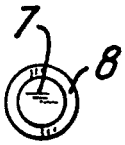
FIG. 5B
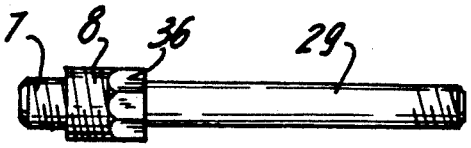
FIG. 5A

EXERCISE APPARATUS

BACKGROUND

FIELD OF THE INVENTION

This invention relates to an apparatus means for enhancing the scope of exercise activities that can be performed using an exercise bicycle.

Presently marketed exercise bicycles provide exercise for the lower torso, particularly the legs. However, such bicycles are deficient in providing exercise to the upper torso. Many models have connections between the pedals and the handlebars of the bicycle which cause the handlebars to move in unison with the pedals and provide only back and forth stretching for the user. Only the legs make the handlebars move. The need for an apparatus that provides arm and upper body exercise in other than a simple back and forth motion is needed to enable the exerciser to take full advantage of the time spent on the exercise bicycle.

SUMMARY OF INVENTION

The apparatus of this invention is a structure that is removably attached to the pedals of an exercise bicycle or a conventional bicycle adapted for use as an exercise bicycle. The apparatus comprises two essentially rigid poles removably attached essentially vertically via a receiving connector, such as an eyebolt or a clip, to the outside end of each of the pedals of the bicycle. A movable crossbar is slidable attached to either of the poles. The crossbar slides up and down the pole to which it is attached and is operably attached thereto by a tee connector on one end of the crossbar. The tee connector is fixedly attached to the cross bar and slidable attached to one pole through the top of the tee that has an inside diameter slightly larger than the pole but not so large that the crossbar slides easily on the pole. When in use, the crossbar can be slightly rotated, thus causing it to be held by friction in place on the pole at a desired location.

The poles are tapered at the lower end so they can fit into receiving connectors, preferably eyebolts fitted in the outside end of each pedal. The connectors are attached to the pedals in a manner that allows them to rotate so that the user can position the poles behind the vertical plane of the user's body on the bicycle, at the vertical plane of the user's body on the bicycle or in front of the vertical plane of the user's body on the bicycle. The poles and/or the crossbar can be held by the operator of the bicycle in any of the noted positions so the user can stretch and exercise desired upper body muscles. Thus, when in use, the apparatus of this invention allows the user to stretch and tone the muscles of the arms, upper body, chest and back.

DESCRIPTION OF THE DRAWINGS

FIG. 2 is a top perspective view of a pedal with an eye-bolt;

FIG. 3 is a side view of the pedal;

FIG. 4 is a view of the end of the pedal that has an eye-bolt;

FIG. 5 is a view of the end of the pedal that attaches to an exercise bicycle;

FIG. 5A is a side view of the bolt that attaches the pedals to an exercise bicycle;

FIG. 5B is an end view of the bolt illustrated in FIG. 5A;

DETAILED DESCRIPTION

Figure 1A:
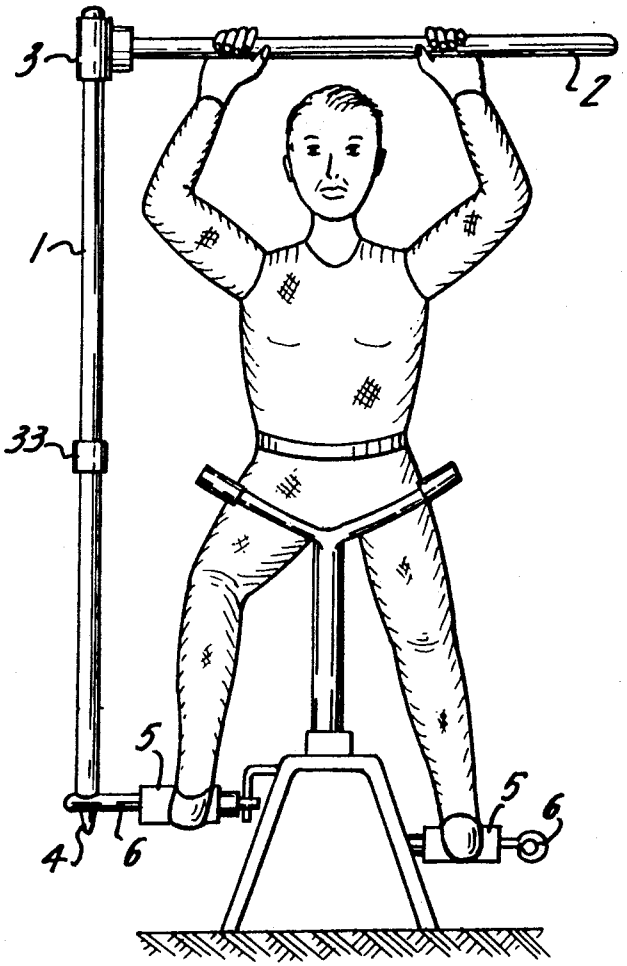
FIGS. 1A, 1B, 1C, 1D and 1E are views showing the apparatus of this invention in use.
Figure 1:
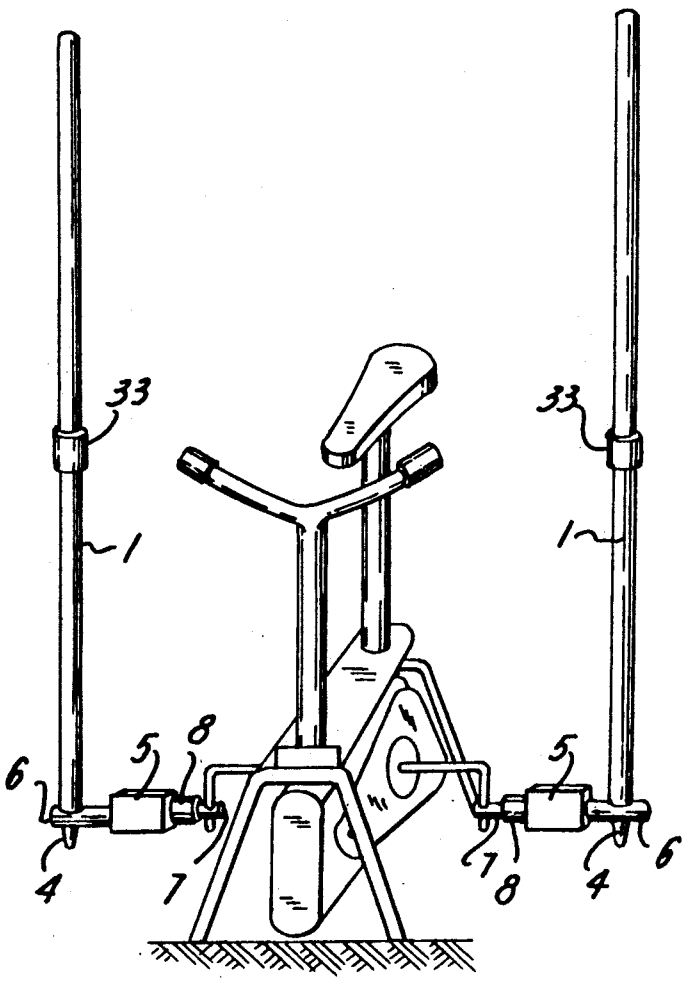
FIG. 1 is a perspective view of the exercise apparatus of this invention attached to an exercise bicycle.

The invention can be best understood with reference to the drawings.

As can be seen from FIGS. 1, 1A, 1B, 1C, 1D and 1E, the exercise apparatus of this invention, which is removably attached to exercise bicycle pedals, comprises two essentially round poles 1 that are each tapered on one end 4 and each is removably inserted at the tapered end 4 into receiving connectors 6, illustrated throughout by the preferred embodiment, i.e. eyebolts, that extend from the outside end of each of the pedals 5 of an exercise bicycle. Although the invention is illustrated with eyebolts, other connectors such as rotatable clips are also suitable and are intended to by included. Each of the pedals 5 are attached to an exercise bicycle pedal arm via ½" bolts 7 or 9/16" bolts 8, depending on the size of the socket in the pedal arms. The mentioned sizes are conventional, but other size bolts can be used if necessary. The connecting bolts 7 and 8 each extend from the pedals 5 through an opening that is sufficiently larger than the diameter of the bolts 7 and 8 to enable the pedals 5 to swivel on their longitudinal axes.

The poles 1 are rigid and preferably hollow. They are made of conventional polyethylene piping or metal piping such as thin walled aluminum piping, other suitable piping materials can be used provided the pipes are rigid and light. The poles 1 can also be made of wood. The poles 1 are preferably made of two pieces, each about three feet long. The pieces are screwed together for use by a threaded fitting 33 as illustrated in FIGS. 8, 1, 1A, 1B, 1D and 1E. One long piece is suitable for the poles 1, however, when two pieces are used, the poles 1 are easier to store when not in use. The outside diameter of the poles 1 depend on the comfort needs of the user. A person with small hands would need poles 1 with a smaller outside diameter than a person with large hands. Poles 1 having diameters of approximately 1" to 1½" would be usually suitable. The poles 1 are tapered at one end 4. The tapering is usually accomplished when the poles are manufactured by conventional means.

Figure 6:
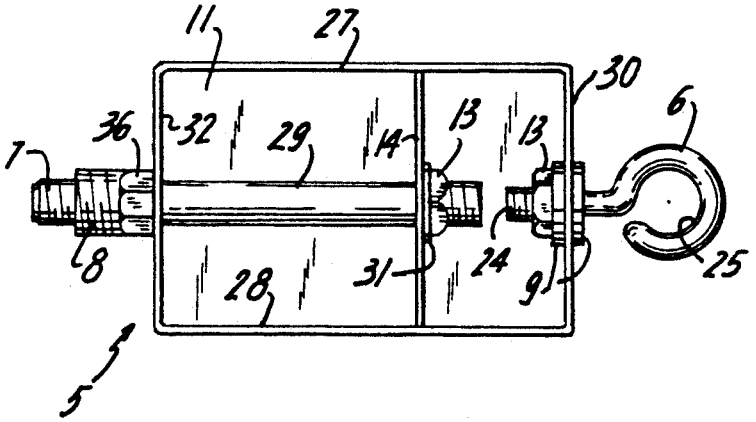
FIG. 6 is a top sectional view of the pedal.
Figure 7:
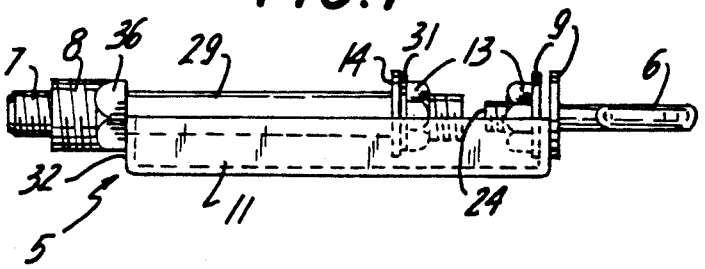
FIG. 7 is a side sectional view of the pedal shown in FIG. 6.
Figure 8:
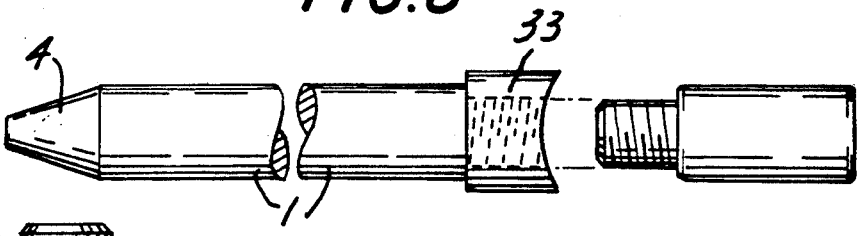
FIG. 8 is a side view of a pole used in the apparatus of this invention.

The eyebolts 6 are conventional metal eyebolts and are attached to the pedals 5 at the outside ends so that they rotate independently of the rotation of the pedals 5 on their longitudinal axes. Preferably the eyebolts 6 or equivalent connectors as discussed above are attached by internal means to the pedals 5 during manufacture as shown in FIGS. 6 and 7. The pedals 5 are conventionally made for exercise bicycles or bicycles adapted for use as exercise bicycles, for example, regular bicycles placed on a frame that holds the rear wheel off the ground.

The eyebolts 6 are held in or on each of the pedals 5 in a manner that allows the eyebolts 6 to rotate. Typically, as shown in FIGS. 6 and 7, each eyebolt 6 is held by a locknut 13 that rests against a washer 9 or sleeve with a diameter sufficiently larger than the eyebolt shaft 24 to allow each eyebolt 6 to rotate on its axis independently of the rotation of the pedal 5 to which it is connected on its axis.

Figure 1C:
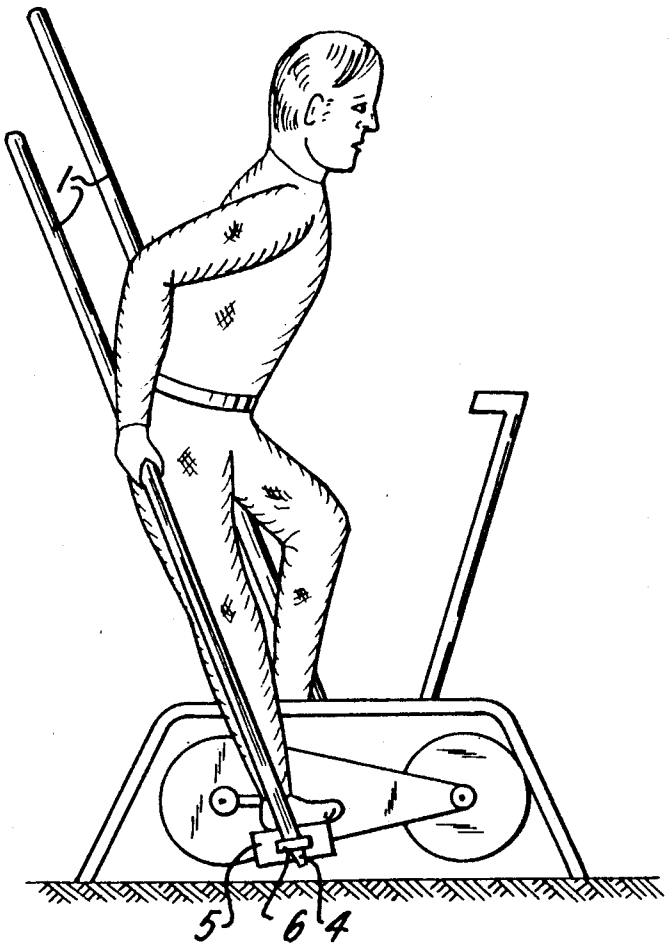
Figure 1B:
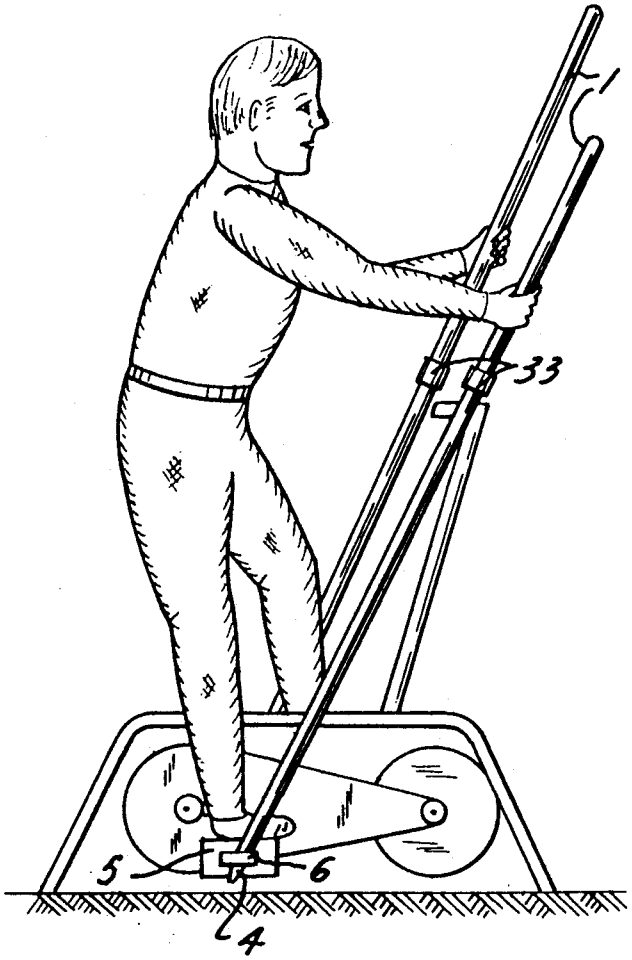

The inside diameter of the eye 25 of each eyebolt 6 is sufficiently larger than the diameter of the tapered end 4 of the pole 1 to which it is connected to permit the user to move each pole 1 independently forward, as shown in FIG. 1B, backward as shown in FIG. 1C, and to the side of the vertical plane of the user's body. The movement can be envisioned as a semicircular movement starting from the vertical plane of the body of the user then front to back and ending in the original vertical position.

Figure 12:
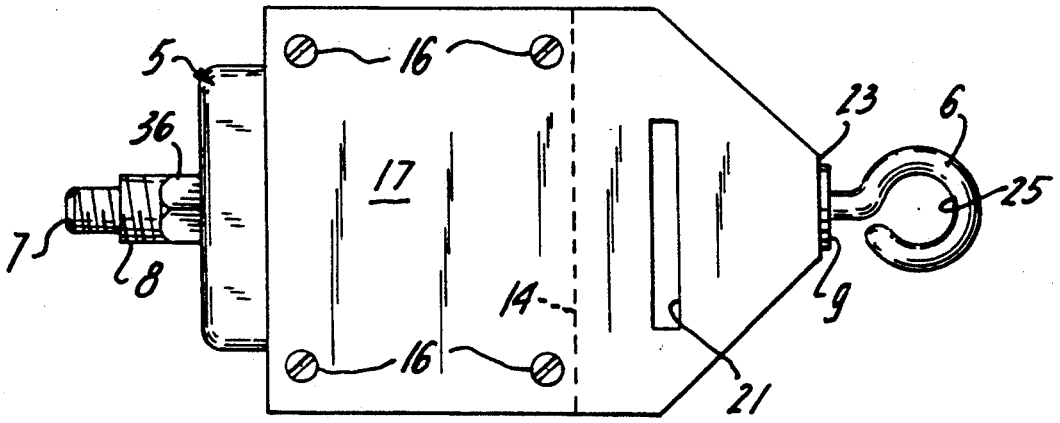
FIG. 12 is a top view of an optional pedal embodiment of FIG. 11.
Figure 11:
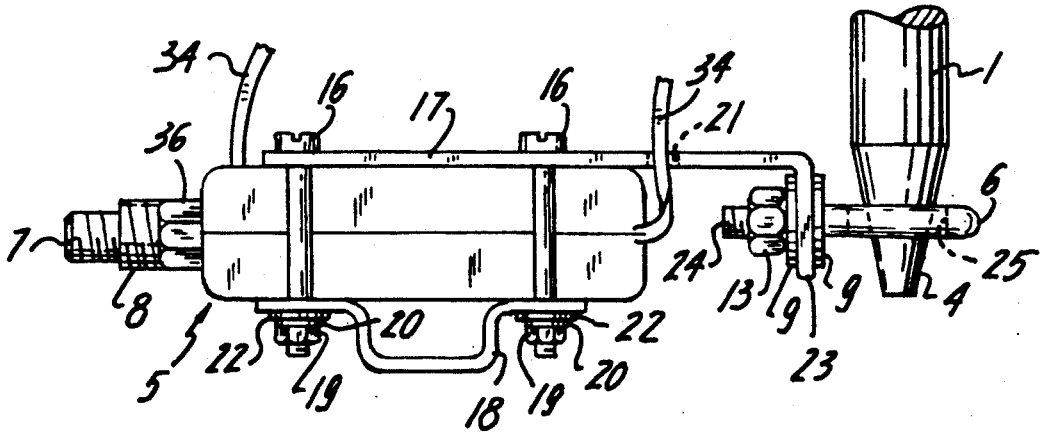
FIG. 11 is a side view of an optional pedal embodiment of the invention.

Each eyebolt 6, or other equivalent connector as discussed above, also can be connected an to existing pedal 5 as illustrated in FIGS. 11 and 12. A metal or rigid plastic plate 17 that fits on the top surface of each pedal 5 is bolted, through holes in the plate 17 with bolts 16, lock washers 20 and nuts 19, to a metal or plastic plate 18 configured to fit on the under surface of the pedal 5. The bolts 16 through the top and bottom plates 17 and 18 are spaced apart so they do not pass through the pedal 5 itself. An eyebolt 6 is attached to each top plate 17 at a downward configured lip 23 at the outside end of each pedal 5 by means of washers 9 and a locknut 13 on the eyebolt shaft 24 which locknut is placed at a position that allows the eyebolt 6 to rotate about its axis independently of the rotation of the pedals 5 about their respective axes as discussed above.

Figure 1E:
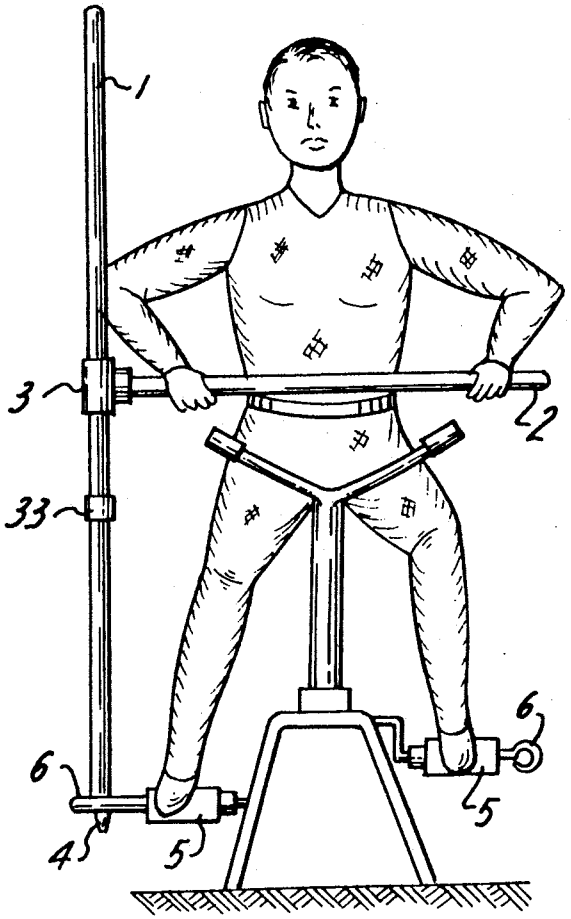
Figure 1D:
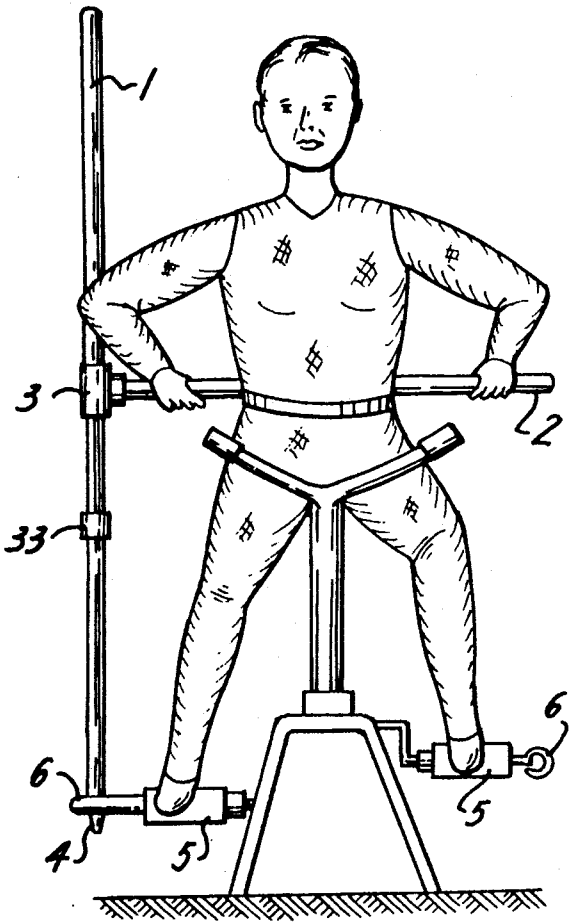
Figure 9:
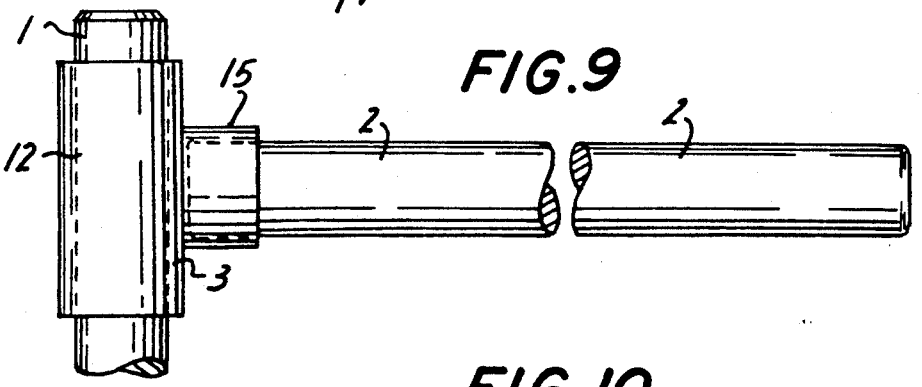
FIG. 9 is a side view of the crossbar that connects to either of the poles of FIG. 8.
Figure 10:
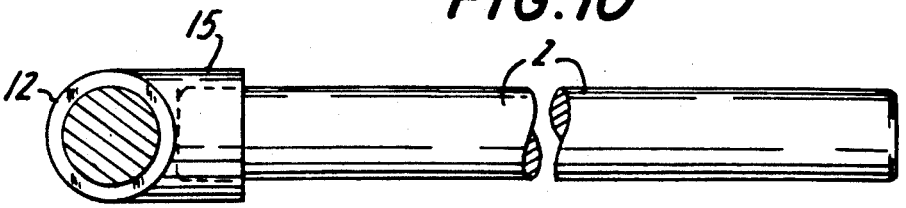
FIG. 10 is a top view of the crossbar.

Additionally if the user wishes, a crossbar 2 as shown in detail in FIGS. 9 and 10 as well as FIGS. 1A, 1D and 1E can be slidably attached to either of the poles 1 by tee fittings 3 on one end of the crossbar 2. Preferably only one pole 1 is used when the crossbar 2 is used. The center leg 15 of the tee fittings 3 fits snugly on one end of the crossbar 2 and the top 12 of the tee fittings 3 slidingly fits on a pole 1. The tee fittings 3 inside diameter is sufficiently larger (about 1/16") than the outside diameter of the poles 1 to permit a slight tilting of the tee fittings 3 to fix them in place by friction on the pole 1. This allows the user to slide the crossbar 2 up and down the pole 1 at will, or keep it in place. In another embodiment, the crossbar 2 can be held in a fixed position on the pole 1 by screws through the top 12 of the tee fitting 2 into the side of the pole 1.

The crossbar 2 is made of the same materials as the poles 1 and is usually of the same diameter. The tee fittings 3 are preferably made of plastic, but can be made of metal, e.g. aluminum, copper or steel.

In use with the crossbar 2 in place, the pole 1 to which the crossbar 2 is attached can be pushed forward from the vertical plane of the body of the user, as shown in FIG. 1E, then pulled backward toward the vertical plane of the body of the user as shown in FIG. 1A. In addition, the user can push the pole 1 to which the crossbar 2 is attached backward from the vertical plane of the body so the crossbar 2 is behind the user as shown in FIG. 1D. The above motions result in stretching and toning the upper body muscles. It is also possible to slide the crossbar 2 up and down the pole 1 to achieve desired height on the pole 1 as shown in FIGS. 1A, 1D and 1E.

FIGS. 2, 3, 4 and 5 illustrate an aspect of the apparatus of this invention in which pedals 5 are manufactured with eye-bolts 6 built in. FIG. 2 illustrates the complete pedal 5 with a flat top 10, four bolts 26 hold the top section 10 to the bottom section 11 of the pedal 5. The bottom section 11 of the pedal 5 is also flat on its bottom part, although it can be contoured as is the pedal 5 illustrated in FIGS. 11 and 12. An eyebolt 6, as shown in FIGS. 2, 3 and 4, extends from the outside end of each pedal 5 through an opening and a washer 9. The bolt 29 which attaches to the pedal arm of the exercise bicycle extends from the inside surface of the pedal 5. Because there are two sizes of sockets used in the pedal arms of various models of exercise bicycles and regular bicycles which can be adapted for use as exercise bicycles, the bolts 29 used in the pedals 5 of the apparatus are designed to fit either socket size as shown in FIGS. 3, 6, 5A and 5B. The bolt 29 is a single unit with two sizes of shaft diameters and threads machined into the shafts. Thus, the smaller bolt threads 7 are about ½" in diameter and the larger bolt threads 8 are about 9/16" in diameter. The bolt 29 is tightened into a pedal arm with a wrench which fits a hexagonal nut 36 which is on the shaft 29 adjacent the threads 7 and 8. An adapter which converts the smaller diameter into a larger diameter or vice versa can also be used.

One method of building the attachment bolts 7 and 8 into the pedal 5 is to use a hollow pedal mold with a partition 14 extending from one inner side surface 27 of the pedal 5, perpendicularly to the other side surface 28 as shown in FIGS. 6 and 7. A bolt 29 with the two thread sizes 7 and 8 and a hexagonal nut 36 on one end is inserted into the pedal inside end wall 32 perpendicularly through an opening in the partition 14 which is parallel to the inside end wall 32 and held with a lock washer 31 by a locknut 13. The diameter of the openings inside end wall 32 of the pedal and in the partition 14 as well as the lock washer 31 are sufficiently larger than the diameter of the bolt 29 to allow the pedal 5 to rotate around the bolt 29 (i.e., the axis of the pedal).

An eyebolt 6 is inserted through an opening in the outside end wall 30 of the pedals 5 in an axial line with the pedal bolt 9 attached at the partition 14 in the pedal mold. The eyebolt shaft 24 is held by lock washers 9 and a locknut 13. The diameter of the opening in the outside end wall 30 is sufficiently larger than the diameter of the eyebolt shaft 24 to enable the eyebolt to axially rotate independently of the axial rotation of the pedal 5. The top section 10 and bottom section 11 of the pedal 5 are bolted together at their corners as shown in FIG. 2.

There are a number of other conventional means for manufacturing pedals and the placement of an eyebolt or other receiving connector therein as in this invention can be accomplished by other means known to the art, for example the inside partition could be replaced by a flange.

The pedals are made of moldable materials such as rubber or plastics, or other materials known to the art of pedal manufacture.

FIGS. 11 and 12, as discussed above, illustrate a pedal 5 modified by bolting on it an upper plate 17 with an eyebolt 6 attached on a lip 23 of the plate 17 and a lower plate 18 that conforms to the shape of the lower surface of the pedal 5. The upper plate 17 also has a foot strap opening 21 near the outside end portion and above the outside edge of the pedal 5 for receiving a foot strap 34 attached to the pedal 5 on its outside edge. The dimensions of the upper plate 17 and the lower plate 18 are such that the bolts holding them on the pedal 5 are outside the perimeter of the pedal 5.

The apparatus of this invention is light, portable and easy to store. It can be adapted to use with any exercise bicycle having pedals or regular bicycle adapted for use as an exercise bicycle and provides exercise and muscle toning for the upper body.

The invention as described can be modified by means conventional in the art using equivalent structures and such modifications are intended to be covered, limited only by the appended claims.

I claim:

1. An apparatus for enhancing an exercise bicycle comprising two essentially vertical elongated rigid poles tapered on one end and two pedals with a receiving connector with holes to receive said poles attached to each pedal wherein, the connectors are axially aligned with and rotatably attached to said pedals at the outside edge thereof so the pedals and connectors rotate independently about the longitudinal axis of the pedal to which the connector is attached, said pedals being adapted for screwing into pedal arms of an exercise bicycle or a regular bicycle adapted for use as an exercise bicycle; the essentially vertical poles are inserted at their tapered end into the receiving opening of the connector that is sufficiently larger than the diameter of the tapered end of the pole to enable the pole to be moved in a circular arc while remaining in the connector opening.

2. The apparatus of claim 1 wherein the connector is an eyebolt.

3. The apparatus of claim 1 additionally comprising a cross bar slidingly attached to one of the vertical poles a with tee fitting that is fixedly attached to one end of the crossbar.

4. A pedal, suitable for use in the apparatus of claim 1 which has built therein at the axis of the end of the pedal facing away from the end of the pedal which screws into a pedal arm of a bicycle an eyebolt which is held in an opening sufficiently larger in diameter than the shaft of the eyebolt to allow the eyebolt to axially rotate independently of axial rotation of the pedal to which it is attached.

5. A pedal adapted for use with the apparatus of claim 1 comprising a bicycle pedal encased in an upper plate and a lower plate wherein the upper plate has a downward configured lip with a rotatably attached eyebolt at its end facing away from the end with a bolt to attach the pedal to a bicycle.

6. The apparatus of claim 1 wherein the poles, crossbar and tee fitting are molded polyethylene pipe.

* * * * *